US007160053B2

(12) United States Patent
Chang

(10) Patent No.: US 7,160,053 B2
(45) Date of Patent: Jan. 9, 2007

(54) BAMBOO MAT BOARD AND METHOD FOR PRODUCING THE SAME

(76) Inventor: Ao Yu Chang, 2F-1, No. 537, Ming Shui Rd., Taipei (TW)

( * ) Notice: Subject to any disclaimer, the term of this patent is extended or adjusted under 35 U.S.C. 154(b) by 0 days.

(21) Appl. No.: 10/923,910

(22) Filed: Aug. 23, 2004

(65) Prior Publication Data

US 2005/0163990 A1 Jul. 28, 2005

Related U.S. Application Data

(62) Division of application No. 10/764,734, filed on Jan. 26, 2004, now Pat. No. 7,021,346.

(51) Int. Cl.
*E01C 5/14* (2006.01)

(52) U.S. Cl. ..... 404/35; 404/42

(58) Field of Classification Search ..... 404/34, 404/35, 41, 42; 428/105, 106, 113; D25/138, D25/157

See application file for complete search history.

(56) References Cited

U.S. PATENT DOCUMENTS

| | | | | | |
|---|---|---|---|---|---|
| 1,036,187 | A | * | 8/1912 | Cable | 52/180 |
| 4,810,551 | A | * | 3/1989 | Chu | 428/106 |
| 5,441,787 | A | * | 8/1995 | Fujii et al. | 428/57 |
| D366,941 | S | * | 2/1996 | Lechleiter et al. | D25/138 |
| 5,786,063 | A | * | 7/1998 | Shibusawa et al. | 428/107 |
| 5,972,467 | A | * | 10/1999 | Washo | 428/107 |
| 5,976,644 | A | * | 11/1999 | Sanaee et al. | 428/17 |
| D417,514 | S | * | 12/1999 | Von Langsdorff et al. | D25/158 |
| D425,633 | S | * | 5/2000 | Hunter | D25/138 |
| D450,859 | S | * | 11/2001 | Abdollahi | D25/138 |
| D462,463 | S | * | 9/2002 | Ogawa | D25/163 |
| 6,641,885 | B1 | * | 11/2003 | Lou | 428/54 |
| 6,722,093 | B1 | * | 4/2004 | Dauplay | 52/314 |
| 7,021,346 | B1 | * | 4/2006 | Chang | 144/333 |

FOREIGN PATENT DOCUMENTS

| | | | |
|---|---|---|---|
| GB | 2292336 | * | 2/1996 |
| JP | 7-197590 | * | 8/1995 |
| JP | 7-229237 | * | 8/1995 |
| JP | 9-24505 | * | 1/1997 |
| JP | 10-280647 | * | 10/1998 |
| JP | 10-317652 | * | 12/1998 |
| JP | 2000-291236 | * | 10/2000 |
| TW | 546197 | | 8/2003 |

* cited by examiner

*Primary Examiner*—Gary S. Hartmann
(74) *Attorney, Agent, or Firm*—Bucknam and Archer

(57) ABSTRACT

A bamboo mat board element with a double-layered construction, a constant dimension, each of the elements is formed with a projecting tenon at each of two adjacent sides, respectively, and a concave mortise at each of the other two adjacent sides, respectively, for inter-tenoning the elements of the mat board, in which a surface layer of the mat board is obtained by matting a plurality of mat board stuffs having different orientations, shapes, and sizes, while each of the mat board stuffs is obtained by matting a plurality of lumbers having a parallel orientation, respectively, to form a plurality of patterns having parallel stripes by specially matting at the longitudinal section thickness of the lumbers. A method for producing the bamboo mat board at least comprises steps as follows: cutting step, boiling for blanching step, drying step, rough shaving, bottom layer pre-forming step, adhesive applying and pressing step, pattern selecting step, matting step, and refined shaving, etc. The sandwich mat board is then formed by pressing.

1 Claim, 6 Drawing Sheets

BAMBOO MAT BOARD AND METHOD FOR PRODUCING THE SAME

This is a divisional of application(s) Ser. No. 10/764,734 filed on Jan. 26, 2004 now U.S. Pat. No. 7,021,346.

BACKGROUND OF THE INVENTION

1. Field of the Invention

The present invention is related to a bamboo mat board and method for producing the same, and more particularly to a method for producing mat board by laminating the blanks of bamboo lumber with the longitudinal section thickness of bamboo lumber up and matched board formed thereof.

2. Prior Art

Owing to gradual depletion of forest resources resulted from massive logging by mankind, the forest resources are strictly controlled by related countries and international society, such that there is a tendency of more and more difficulty for acquiring wood. Due to the rapid growth of bamboo harvestable in about three years resulting in easy acquirement, as well the fiber having fine texture and the better toughness than wood provided by bamboo, there is a merit for bamboo to replace a part of demand for wood. In view of the fact that, however, only a peripheral portion in thickness of bamboo may be practically used, which is resulted from a smaller diameter and hollow core of bamboo, resulting in a difficult manufacture, the inventor has been thus developed the present invention providing an efficient method for forming a laminated layer by means of bamboo lumber with a constant width longitudinally sectioned through bamboo, and subsequently forming a normalized mat board with beautiful appearance and higher stiffness than wood by matting at the longitudinal section thickness of bamboo, for facilitating a large construction area on the floor and wall.

In the conventional art, for example, TAIWAN Patent Publication No. 546197, as illustrated in FIGS. 6*a* and 6*b*, there is disclosed a "Method For Producing Assembled Bamboo Flooring", mainly comprising steps as follows: cross sawing and longitudinal sawing the quinquennial bamboo, such as moso bamboo, into slender board-like bamboo stuffs (1), and juxtaposing several pieces of that board-like bamboo in width direction; subsequently laminating other bamboo stuffs (1', 1") formed by the same method described above onto the bamboo stuffs (1); and laterally staggering seams (2) of upper and lower bamboo stuffs (1, 1', 1"); gluing the seams (2) and laminated overlapping portions (3) by means of the adhesive without containing poisonous chemicals, such as formaldehyde, for instance, to form a laminated board (30); and forming a trench (7) at the bottom surface of the lowermost bamboo stuff (1") of the laminated board (30).

SUMMARY OF THE INVENTION

It is the main object of the present invention to provide a bamboo mat board developed for effectively utilizing bamboo to produce a mat board with high stiffness in order for replacing a part of demand for wood, resulting in raised economic value of bamboo.

For achieving aforementioned and other objects, the bamboo mat board of the present invention includes elements having a constant dimension, each of which at least comprises a double-layered construction formed with a projecting tenon at each of two adjacent sides, respectively, and a concave mortise at each of the other two adjacent sides, respectively, for inter-tenoning the elements of the mat board, in which a surface layer of the mat board is obtained by matting a plurality of mat board stuffs having different orientations, shapes, and sizes, while each of the mat board stuffs is obtained by matting a plurality of lumbers having a parallel orientation, respectively, to form a plurality of patterns having parallel stripes by specially matting at the longitudinal section thickness of the lumbers. For this bamboo mat board, not only the beautiful appearance and the higher stiffness than wood, but also the easy construction on the floor and wall may be obtained.

It is another object of the present invention to provide a method for producing bamboo mat board for manufacturing the mat board in a manner of more simplicity and raised production efficiency, the producing method according to the present invention at least comprising steps as follows:

cutting step: cutting the bamboo raw stuff to a predetermined length, and in turn, sectioning it into lumbers with a determined width;

boiling for blanching step: immersing the lumbers with predetermined width into hot water to boil them for a period of time in order to expel the moisture contained in the fiber out;

drying step: drying the hot water-immersed lumbers such that these lumbers may be air-dried to a predetermined humidity after a period of time;

rough shaving: barking and rough shaving the dried lumbers to form a smooth surface by the rough shaving machine, bottom layer pre-forming step: applying the surface of the rough shaved lumbers with adhesive, and arranging these lumbers in a peripheral face-facing upward, longitudinal section-glued together manner, in order to form the bamboo board stuff; and in turn, shaving the surface of this bamboo board stuff and cutting it into a bottom layer with a constant dimension;

adhesive applying and pressing step: applying the surface of the rough shaved lumbers with adhesive, and arranging these lumbers in a longitudinal section-facing upward, peripheral face-glued together manner, in order to form the mat board stuff by the high pressure-high temperature pressing;

pattern selecting step: shaving the surface of the pressed mat board stuff, and getting a plurality of patterned boards having different shapes and dimensions by segmenting depending on the pre-designed figure;

matting step: applying adhesive onto the plurality of patterned boards having different shapes and dimensions, as well as matting these patterned boards on the aforementioned bottom bamboo board stuff and forming a sandwich mat board by the high pressure-high temperature pressing; and refined shaving: polishing the surface of the mat board, as well as applying the surfaces of the surface layer and bottom layer with paint; etc., to form a protective coating. Thus, the product is finished.

DETAILED DESCRIPTION OF THE INVENTION

The above and other technical matters, objects, features, and advantages of the present invention will be clearly appreciated from the following detailed description of one preferred embodiment taken in conjunction with the accompany drawings.

Figures 1, 1A, 1B, 1C:
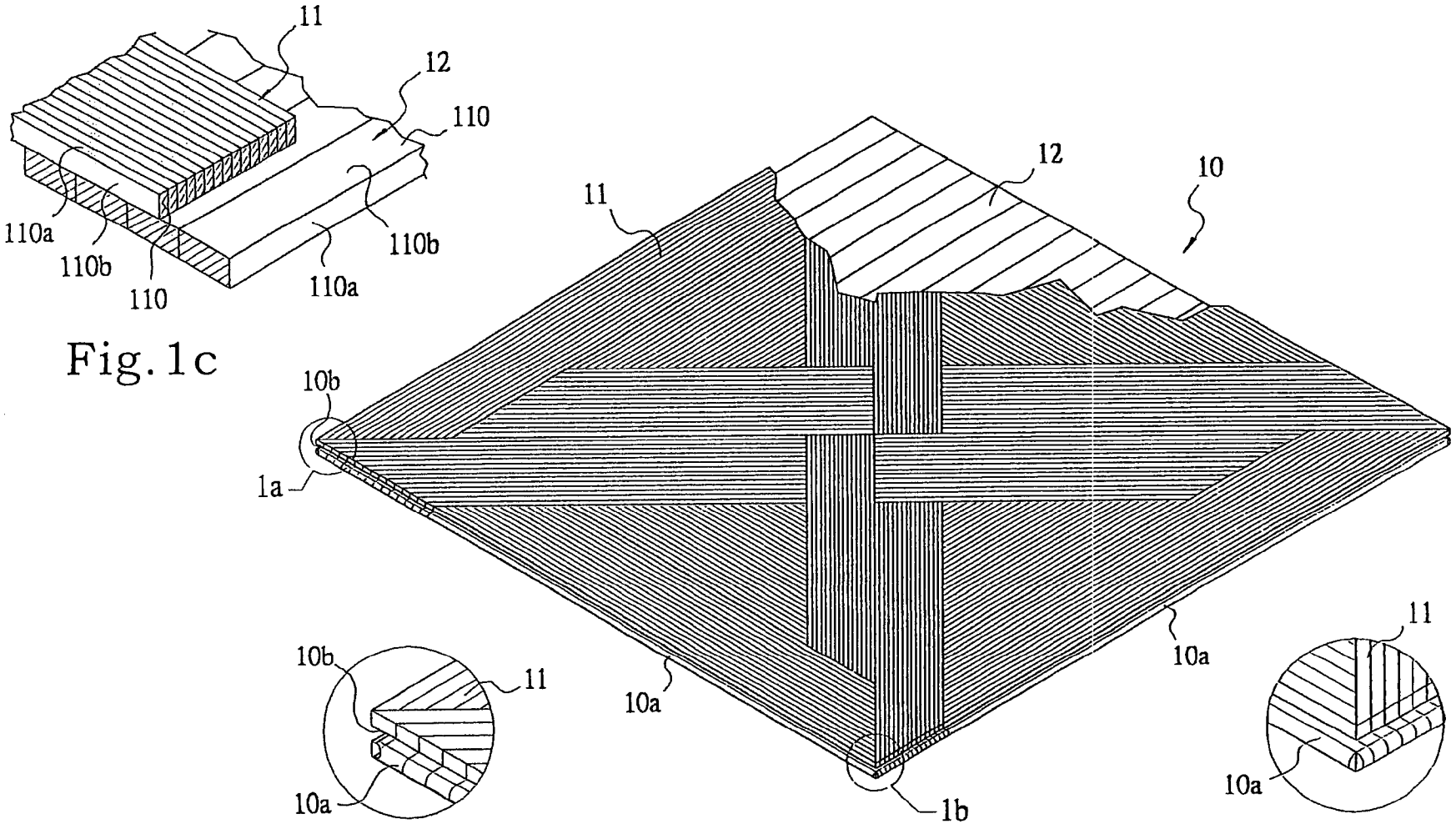
FIG. 1 is a perspective view of a bamboo mat board according to one embodiment of the present invention, partly of which is sectioned.
FIG. 1*a* is a partially enlarged view of a potion illustrated as a circle 1*a* in FIG. 1.
FIG. 1*b* is a partially enlarged view of a potion illustrated as a circle 1*b* in FIG. 1.
FIG. 1*c* is a partially enlarged cross section view according to the embodiment shown in FIG. 1.
Figure 2:
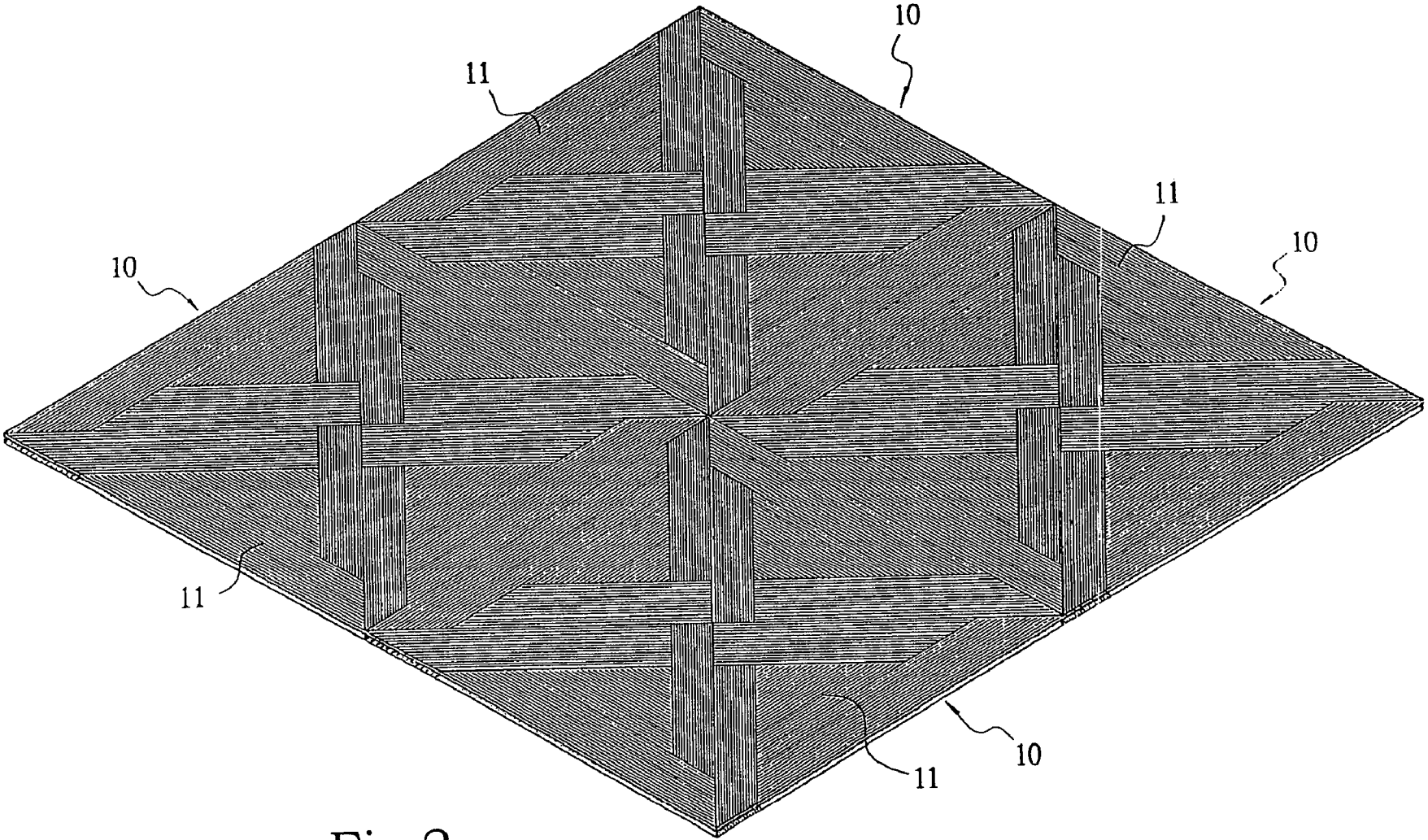
FIG. 2 is a diagram showing the inter-tenoning between the elements of the bamboo mat board of the present invention.

Referring to FIG. 1 together with FIG. 2, firstly, a bamboo mat board 10 of the present invention, presented as a block element of square having a constant dimension, is formed by gluing and subsequently pressing at least surface mat board stuff 11 and bottom bamboo board stuff 12. The element of the mat board 10 is formed with a projecting tenon 10*a* at each of two adjacent sides, respectively, and a concave mortise 10*b* at each of the other two adjacent sides, respectively (referring to FIGS. 1*a* and 1*b*), in such a way that the elements of the mat board 10 may be tenoned with each other to boundlessly expand in front-back and left-right directions to be suitable for the construction on the floor or wall.

In the present invention, as shown in FIG. 1*c*, the surface layer of the element of the mat board 10 is formed by matting several mat board stuffs 11 having different orientations, shapes, and sizes, while each of the mat board stuffs 11 is obtained by matting a plurality of lumbers 110 having a parallel orientation, respectively, to form a plurality of patterns having stripes by specially matting at a longitudinal section 110*a* thickness of the lumbers 110. In this case, the lumber 110 is obtained from bamboo raw stuff, previously cut in lengthwise direction and subsequently longitudinally sectioned to form the lumber 110 having a peripheral face 110*b* having a constant width of 2 cm and a longitudinal section 110*a* having a thickness of approximate 5~6 mm. Subsequently, after a series of boiling, air-drying, and shaving processes; the mat board stuff 11 is formed by pressing the plurality of lumbers 110 having a parallel orientation in a longitudinal section 110*a* facing upward, peripheral face 110*b* -glued together arrangement. It is followed by pattern selecting to cut this formed mat board stuff to a shape, size, etc., which is suitable for matting. Moreover, a bottom bamboo board stuff 12 of the mat bamboo element 10 is formed, by pressing the plurality of lumbers 110 having a parallel orientation, in a peripheral face 110*b* -facing upward, longitudinal section 110*a* -glued together arrangement, and arranged staggeringly with respect to the surface mat board stuff 11, in order for constituting a strong construction.

Figure 3:
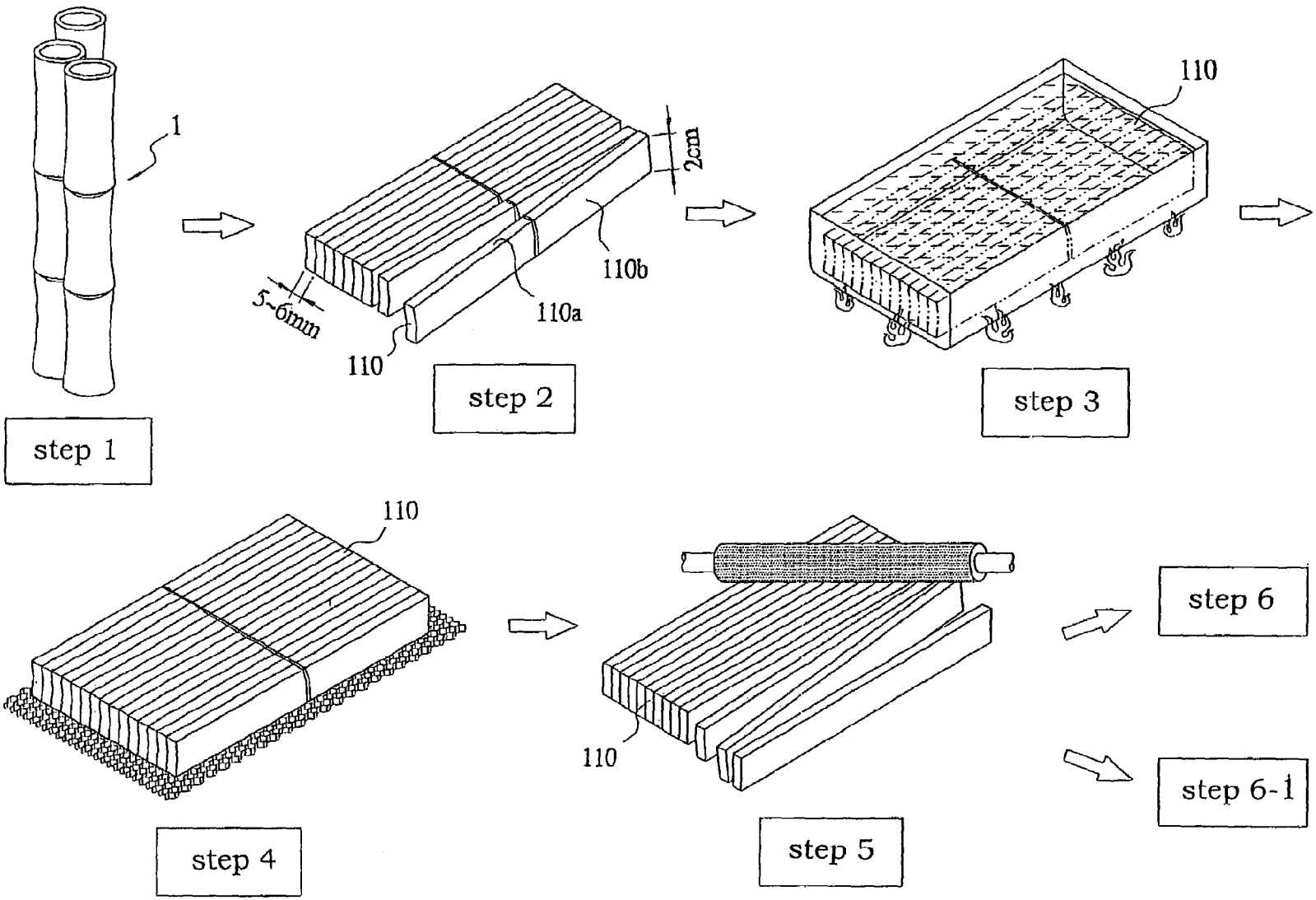
FIG. 3 is a procedure diagram of a method for producing bamboo mat board of the present invention.
Figure 4:
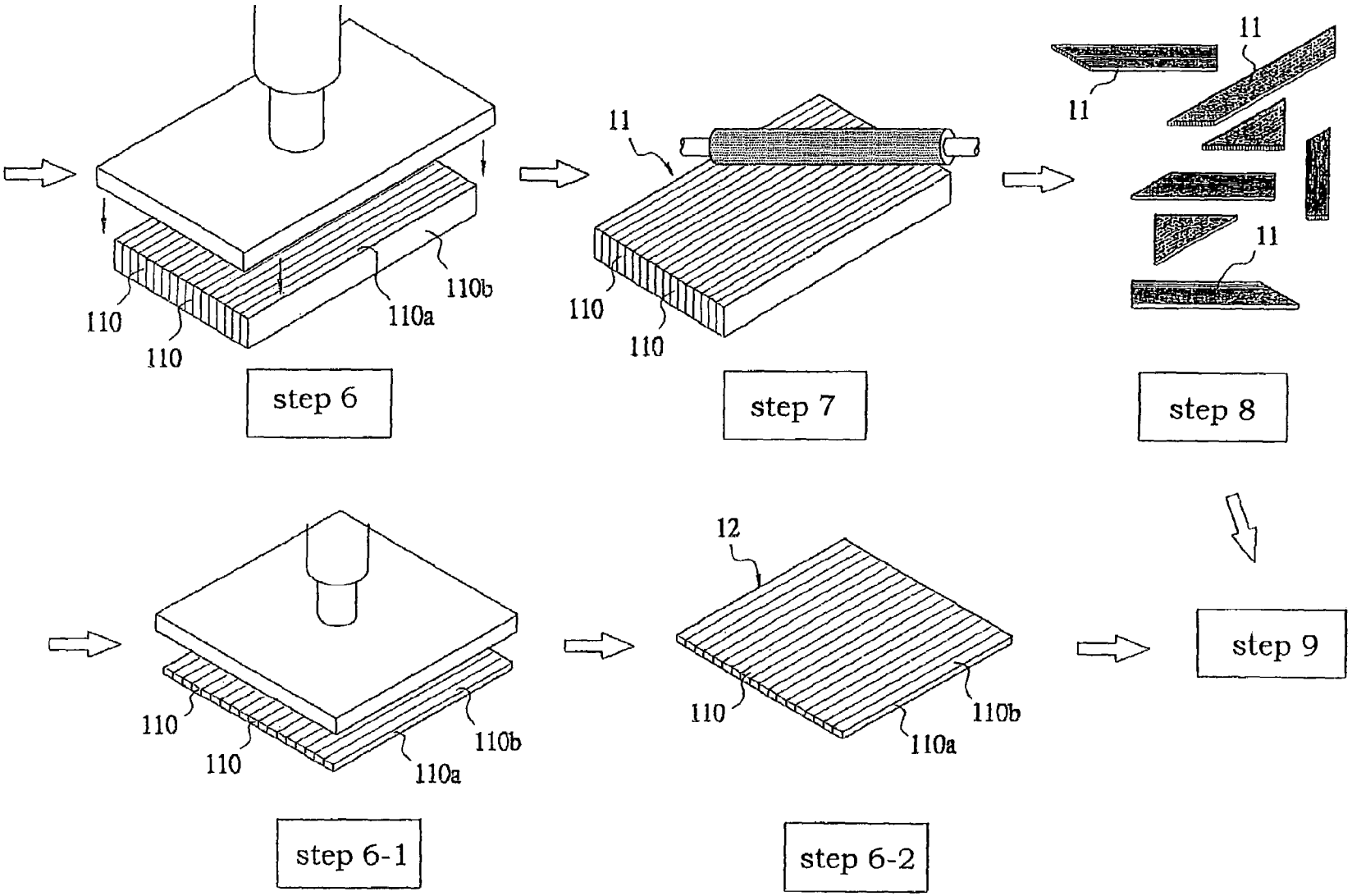
FIG. 4 is a procedure diagram following FIG. 3.
Figure 5:
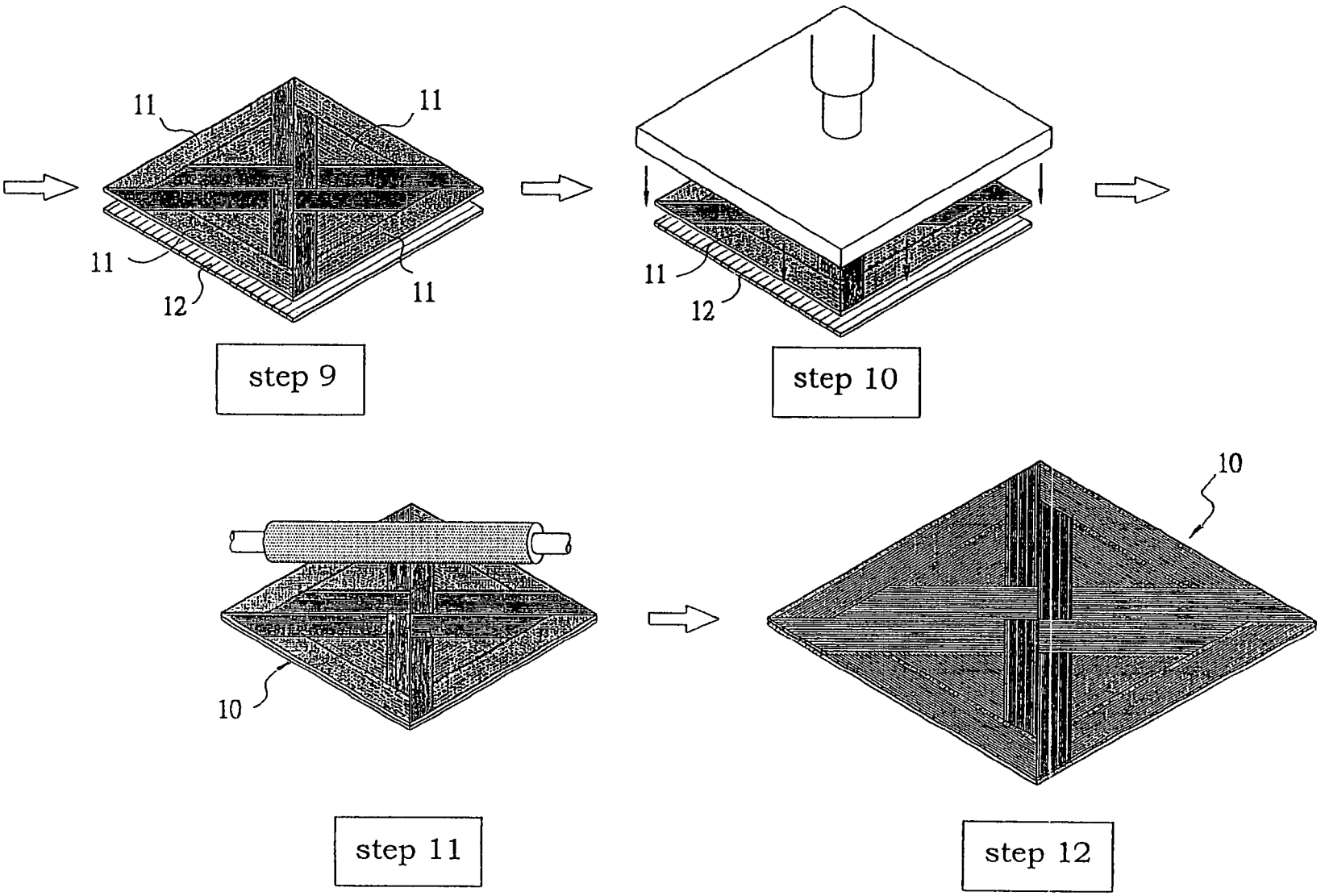
FIG. 5 is a procedure diagram following FIG. 4.
Figure 6A:
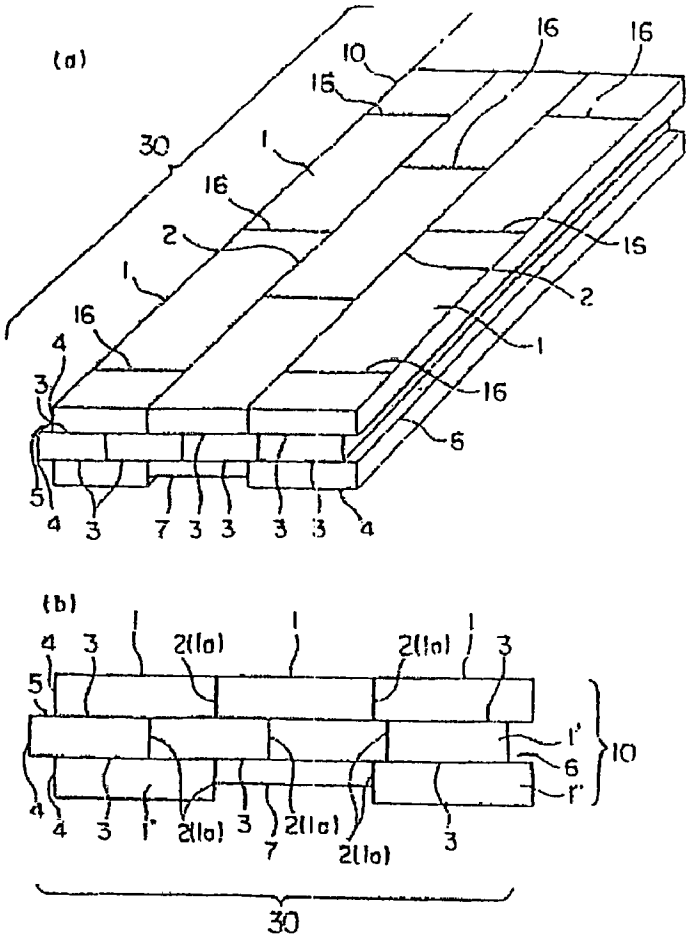
(Prior Art) Fig.6a
FIG. 6 is a diagram of the conventional art redrawn in accordance with TAIWAN Patent Publication No. 546197; entitled "Assembled Moso Bamboo Flooring".
Figure 6B:
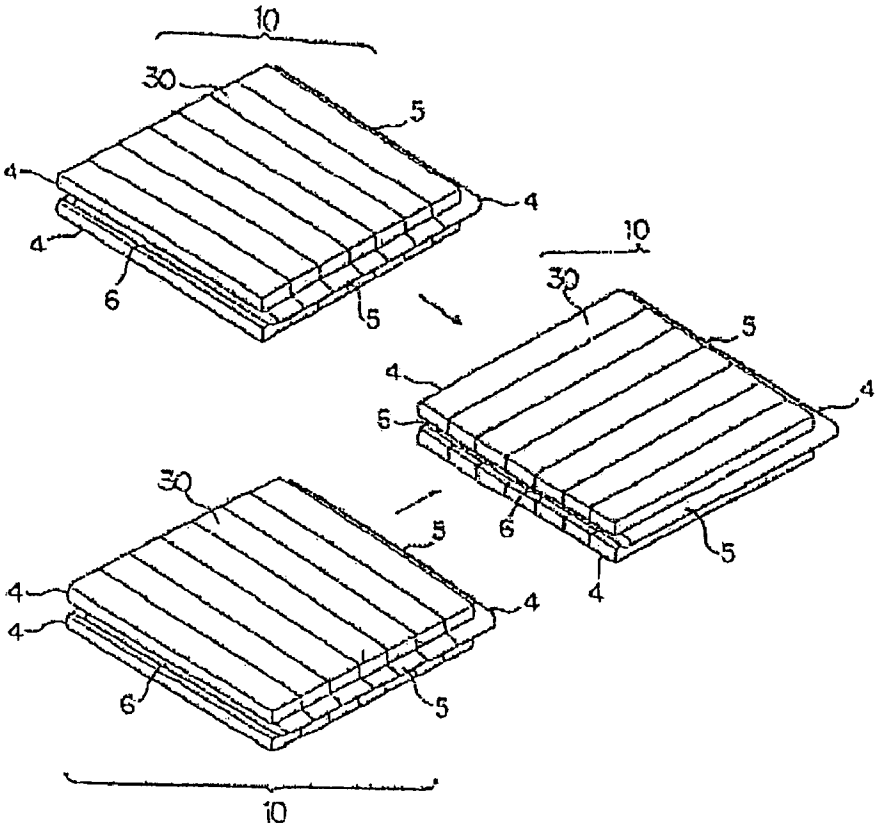
(Prior Art) Fig.6b

Referring to FIGS. 3, 4, and 5, a method for producing the bamboo mat board 10 of the present invention is further described in one embodiment, the method at least comprising steps as follows:

Cutting step: In step 1, a bamboo raw stuff 1 with a peripheral face having a thickness of at least greater than 5 mm and growing over approximate three years is selected, and then the former is cut to a constant length suitable for being manufactured. In step 2, the bamboo raw stuff 1 having a constant length is longitudinally sectioned in axial direction into the lumbers 110 having an identical width, and bamboo joints, etc., are roughly trimmed, such that the lumbers 110 may be normalized to be approximate 2 cm wide in the peripheral face 110*b* and approximate 5~6 mm thick in the longitudinal section 110*a*.

Boiling for blanching step: In step 3, the lumbers 110 are immersed in hot water to be boiled at the temperature of approximate 60° C.~90° C. adjusted depending on the amount of the lumbers and the weather factor for a period of time of approximate 5~8 hours in order to expel the moisture contained in the fiber out.

Drying step: In step 4, the drying: for the hot water immersed and boiled lumbers 110 is performed for air-drying these lumbers to a predetermined humidity after a period of time.

Rough shaving step: In step 5, the dried lumbers 110 are barked and rough shaved to form a smooth surface by the rough shaving machine.

Bottom layer pre-forming step: In step 6-1, applying the sides of the rough-shaved lumbers 110 with adhesive, and arranging them in a peripheral face 110-facing upward, longitudinal section 110*a*-glued together manner in order to form a bamboo board stuff 12 by pressing under high pressure (about 6000 lb) and high temperature for approximate 4 to 6 hours. Further, in step 6-2, this bamboo board stuff 12 is shaved smooth and cut to a constant dimension to function as the bottom layer.

Adhesive applying and pressing step: In step 6, the surface of the rough-shaved lumbers 110 finished in step 5 is applied with adhesive, and these lumbers are arranged in a longitudinal section 110*a*-facing upward, peripheral face 110*b*-glued together manner to form the mat board stuff 11 by pressing under high pressure (about 6000 lb) and high temperature in the hydraulic press for approximate 4 to 6 hours.

Pattern selecting step: In step 7, the surface of the pressed mat board stuff 11 is shaved smooth; and in step 8, the mat board stuff 11 is cut into a plurality of required patterned boards 11 having different shapes and dimensions depending on the pre-designed figure;

Matting step: In step 9, the bottom surface of the plurality of the patterned boards 11 having different-shapes and dimensions is applied with adhesive, and these patterned boards are matted on the aforementioned bottom bamboo-board stuff 12; and in step 10, the surface mat board stuff 11 as well as bottom bamboo board stuff 12 are pressed under high pressure (about 6000 lb) and high temperature in the hydraulic press for approximately 4 to 6 hours in order to form a sandwich construction of the mat board 10.

Refined shaving step: In step 11, the surface of the pressed mat board 10 is surface; and in step 12, the polished surfaces of the surface layer and bottom layer of the mat board 10 are applied with paint to form a protective coating. In this way, the mat board product having a surface with striped pattern is finished.

The foregoing description is merely one embodiment of present invention and not considered as restrictive. All equivalent variations and modifications in accordance with the appended claims may be made without in any way from the scope of the invention.

To sum up, the bamboo mat board and the method for producing same of the present invention is allowed for effectively utilizing bamboo to manufacture the mat board with high stiffness in order for achieving the raised economic value of bamboo and the partly reduced demand for wood, etc., Therefore, owing to the enhanced effect, the present invention is truly an invention with novelty, advancement, and availability by the industry.

LIST OF REFERENCE SYMBOLS

1 bamboo raw stuff
10 bamboo mat board
11 mat board stuff
110 lumber
110*a* longitudinal section
110*b* peripheral face
12 bamboo board stuff

What is claimed is:

1. A bamboo mat board element (10) with a constant dimension having a surface layer and a bottom layer construction formed with a projecting tenon (10*a*) at each of two adjacent sides and a concave mortise (10*b*) at each of two other adjacent sides for inter-tenoning said mat board element with neighboring mat board elements, the surface layer of said mat board element (10) being comprised of a plurality of mat board stuffs (11) wherein each of said mat board stuffs (11) includes a plurality of bamboo lumbers (110) having a parallel orientation forming a mat board stuff (11) having parallel stripes, said plurality of mat board stuffs (11) being arranged in different orientations, shapes and sizes on the surface of said mat board element (10) so as to form a plurality of patterns having parallel stripes, and wherein said bamboo lumbers (110) are disposed in said mat board stuffs (11) with a longitudinal cross section (110*a*) facing upward and peripheral face (110*b*) glued together arrangement, said longitudinal cross section (110*a*) substantially corresponding to a longitudinal cross section in the axial direction of a raw bamboo segment (1) and said peripheral face (110*b*) substantially corresponding to the peripheral face of said longitudinally sectioned raw bamboo segment (1), and said bottom layer of said mat board element (10) being comprised of a plurality of bottom board stuffs (12) wherein each of said bottom board stuffs (12) includes a plurality of bamboo lumbers (110) having a parallel orientation wherein said bamboo lumbers (110) are disposed in said bottom board stuff (12) with a peripheral face (110*b*) facing upward and longitudinal cross section (110*a*) glued together arrangement, said mat board stuff (11) and said bottom bottom board stuff (12) being glued and subsequently pressed together.

* * * * *